United States Patent [19]

Scott

[11] Patent Number: 4,813,469

[45] Date of Patent: Mar. 21, 1989

[54] LOUVER BLIND CONTROL

[76] Inventor: Kenneth W. Scott, 601 9th St., Coronado, Calif. 92260

[21] Appl. No.: 137,099

[22] Filed: Dec. 23, 1987

Related U.S. Application Data

[63] Continuation-in-part of Ser. No. 882,286, Jul. 7, 1986, abandoned.

[51] Int. Cl.[4] ..... E06B 9/38

[52] U.S. Cl. ..... 160/178.2; 160/900; 188/65.1

[58] Field of Search ..... 160/166.1, 178.1, 178.2, 160/168.1, 176.1, 331, 319, 320, 321, 344, 345; 188/65.1, 65.2, 65.3, 65.4, 65.5; 24/115 R, 115 J, 115 G, 115 H, 116 R, 122.6, 136 R

[56] References Cited

U.S. PATENT DOCUMENTS

| | | | |
|---|---|---|---|
| 2,991,526 | 7/1961 | Kuebler | 188/65.1 X |
| 3,050,803 | 8/1962 | Hulterstrum | 188/65.1 X |
| 3,123,182 | 3/1964 | Malone et al. | 188/65.1 |
| 3,633,646 | 1/1972 | Zilver | 160/168 |
| 3,727,665 | 4/1973 | Debs | 160/178.2 |
| 3,931,846 | 1/1976 | Zilver | 160/178.2 |
| 4,271,893 | 6/1981 | McCluskey | 160/178.1 |

FOREIGN PATENT DOCUMENTS

| | | | |
|---|---|---|---|
| 1136461 | 9/1962 | Fed. Rep. of Germany | 160/178.2 |
| 3035027 | 4/1982 | Fed. Rep. of Germany | 160/178.2 |

*Primary Examiner*—Ramon S. Britts
*Assistant Examiner*—David M. Purol
*Attorney, Agent, or Firm*—Ralph S. Branscomb

[57] ABSTRACT

A control is provided for louver blinds of the kind that hang vertically, although it would work for horizontally extended blinds and any other curtain or window cover in which both a double chain and a double cord or their equivalents were used. The control provides longitudinal channels through which the chains and cords pass, and are controlled by a cam and release bar arrangement to grip one of the cords, and three plungers to grip the other cord and two chains and exit the opposite side of the body of the control so that the control is easily gripped in one hand with the release bar pressed by the fingers and the thumb pressing a selected one of the buttons, or vice versa, so that all blind movements are made by pulling the control down, and lifting it back up in idling mode to pull down again, if necessary.

15 Claims, 2 Drawing Sheets

FIG. 6
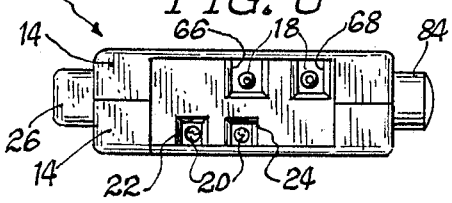
FIG. 7
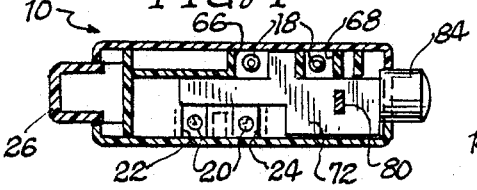
FIG. 8
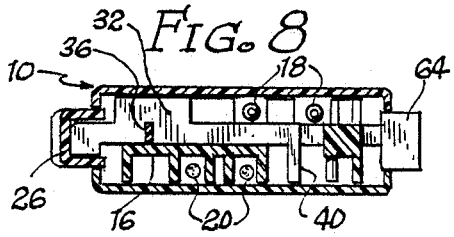
FIG. 9
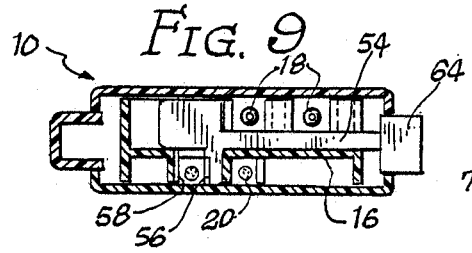
FIG. 10
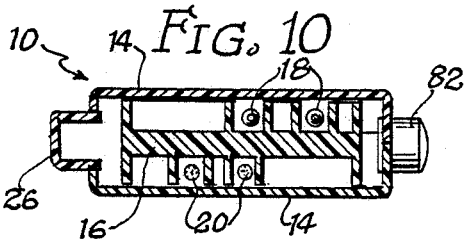
FIG. 11
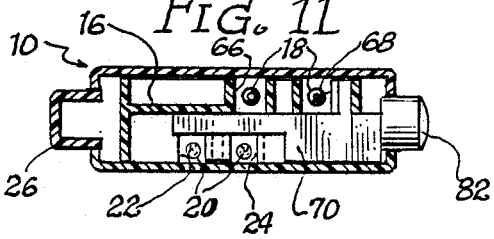
FIG. 12
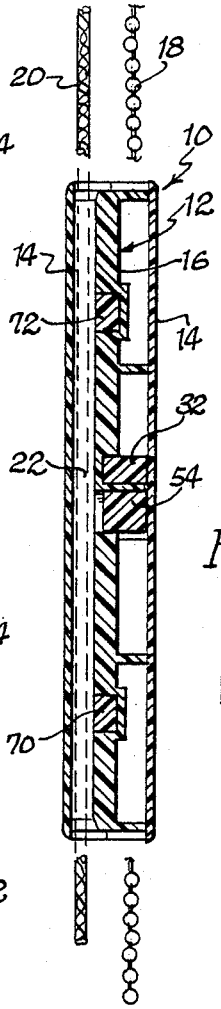
FIG. 13
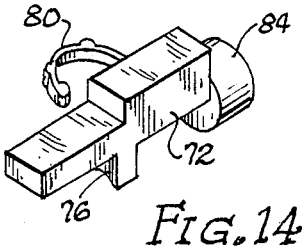
FIG. 14
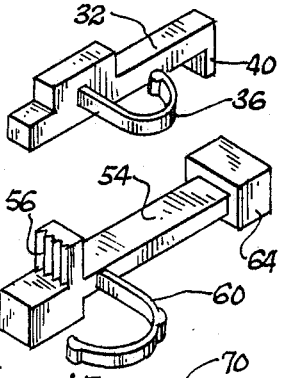
FIG. 15
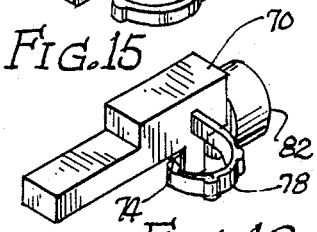
FIG. 16

LOUVER BLIND CONTROL

BACKGROUND OF THE INVENTION

The instant invention is in the field of louver blind controls and is a Continuation in Part Application of Application No. 882,286, filed 07/07/86, now abandoned for HAND CONTROL PULL FOR OPERATING LOUVRE BLINDS, the inventor being the same as the instant inventor.

This invention has been in the development process for many months and has been constantly improved as it has come closer and closer to being in production. The current unit, to which this patent application is drawn, is now a product produced by plastic injection molding. All biasing is created by leaf springs which are unitary with the part that they bias, and the body covers snap together over the core of the body so that no fasteners are required, although the embodiment which has been illustrated shows screws which hold the cover of the body together as the snap-on nibs have not been incorporated into the mold.

As anyone knows who has used pull drapes or vertical blinds, whether vertically or horizontally extended, pulling the cords which control the blinds or drapes can be a nuisance. In the worst case, which many people tolerate, the hanging cords or chains are loose, not being tied down at their lower end so that first the user must grapple behind a curtain to find the cords and then must pull one of the cords experimentally to see if it is the correct one and move on until the correct cord or chain is finally selected.

Although this is admittedly a minor problem in the universe of diasters which have befallen mankind and the dilemmas which he still faces, nonetheless, its solution provides one further step in the irreversible march toward the best of all possible worlds in which mankind is engaged. Put another way, although selection and pulling of the cords and chains that control one's louver blinds does not pose one of life's larger challenges for most of us, nonetheless, once having used the louver blind control of the instant invention, which the inventor has done for many months now in one form or another, one would not be choice revert back to the more primitive technique with which those of us other than the inventor have had to deal in controlling our louver blinds and curtains. Whereas one might not have control over the nuclear arms race and the destiny of mankind in general, at least it is something of a comfort to know that one can quickly and effectively shut the blinds on the blinding nuclear flash while perhaps ones neighbor, not in such fortunate circumstances, is still fiddling with the cords.

SUMMARY OF THE INVENTION

To further man's mission in his own small way, the inventor has devised the following. The vertical blind control of the instant invention has been reduced to the simplest and most effect form conceivable for both production, assembly, and utilization and repair. It is made of a body having a central core, defining a plane with baffles on both sides, with this core being enclosed on both sides by identical covers which snap into place or are connected by bolts to encapsulate the entire device, including the several plungers and a cam that are necessary to cooperate with the interior baffle structure to control both the chains and the cords.

The central divider defined by the body core defines by integrally molded baffles a pair of channels on one side which pass the two chains controlling the rotation of the louver elements, and the two cords on the other side which control traversing the louvers together either to one side of the window or back, as with the depending vertical blinds, or up and down as with horizontal blinds. In both cases, each of the plungers which controls the cord or chain, as the case may be, in the respective channel rides in a corridor defined by baffles on the opposite side of the central divider from the cord or chain baffles, and has a member extending through the baffles to control the cord or chain.

Of the four moving members necessary to control the four cords and chains (that is, two each), three are plungers which extend through the control as buttons and are normally biased into their non-engaging mode, and the fourth is a release bar on the opposite side of the body from the buttons, which is normally biased into a cord-engaging mode so that the control hangs on the cord and does not fall down the cords and chains to the floor. Thus, if one pulls the control down withoug depressing any of the buttons or the release bar, the release bar is normally engaged in that cord which will cause the louvers to traverse closed if the control is properly attached.

The interior construction of the control is carefully thought out and engineered so that all springs are unitary elements molded integrally with their respective plungers, or in one case a cam element. The cam element is reversible, which cooperates with the symmetry of the control so that the control can be installed with either end up and used with a blind which has various chain and cord configurations. When correctly installed on the cords and chains, the unit will cause the louvers to traverse into place across the window if neither the release bar nor any of the buttons is depressed as the control is pulled down, and the unidirectional cam which the release bar operates permits the unit to be slide upwardly without moving anything if the upward motion is accomplished without pushing any of the buttons. Beyond traversing the blinds closed, the central button depressed with the release bar will traverse the blinds open, and the operator must learn himself whether the top of bottom button controls the rotational opening of the individual elements, and vice-versa.

BRIEF DESCRIPTION OF THE DRAWINGS

FIGS. 6 through 12 are sections taken along lines 6-6 though 12—12 of FIG. 4, respectively;

FIG. 13 is an isometric view of the first chain plunger;

FIG. 14 is an isometric view of the cam cord plunger;

FIG. 15 is an isometric view of the camless cord plunger; and;

FIG. 16 is an isometric view of the second chain plunger.

DETAILED DESCRIPTION OF THE PREFERRED EMBODIMENT

Figure 1:
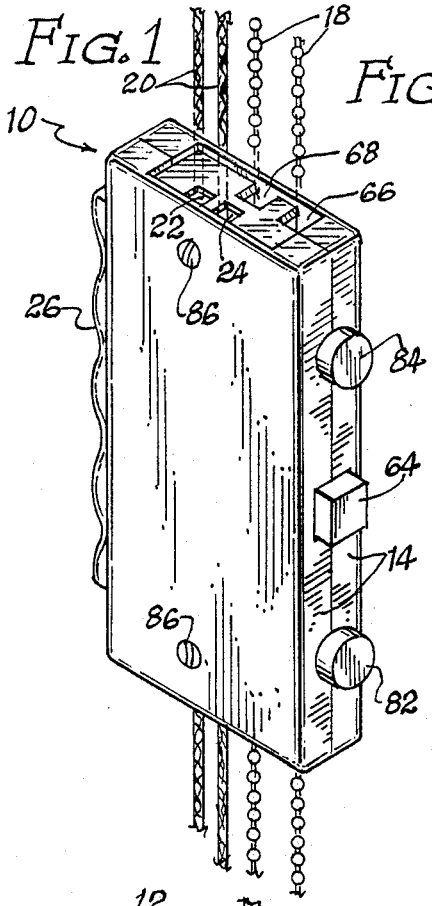
FIG. 1 is an isometric view of the control in place, mounted over the control chains and cords.

The control has a body 10 comprising a central core member 12 and identical covers 14. The core 12 has a central partition 16 having a series of baffles on both sides which define the various corridors, channels, and leaf spring buttresses for all of the moving elements of the control. The partition substantially bisects the control, and in the illustrated embodiment has a certain thickness into which deep channels are formed as part of the cord and chain channels. All of the parts of the device are made by plastic injection molding except for a couple of bolts which hold it together, and they probably will be replaced by snap-on nibs in the covers before the first production run.

In the preferred embodiment, the control is used on a vertical louver blind having a pair of chains 18, which would ordinarily be both sides of a single chain terminating in a loop at the bottom, and a pair of cords 20, also ordinarily part of a continuous cord loop. The chains control rotation of the louvers around their longitudinal axes, and the cords control the movement which traverses all the louvers to one or both sides of the window, or back in place across the window.

Control of the cords will be described first, and in order to do this, the cords pass through a pair of longitudinally oriented channels 22 and 24 suitably defined by the baffles of the core 12. The cord in the channel 24 is controlled by the release bar 26. The release bar fits more or less loosely in the long slot 28 defined in both of the covers 14, and at the ends of the release bars are a pair of flanges 30 that engage under the edges of the slot 28 to prevent the bar from coming completely out of the body of the control.

Figure 2:
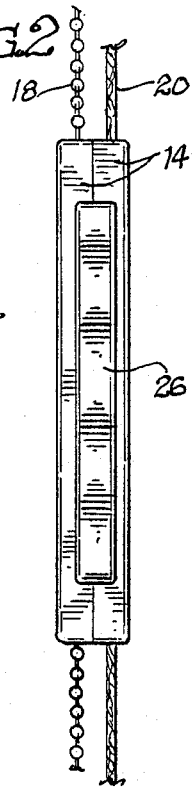
FIG. 2 is an end elevation view as the control would appear from the left side of FIG. 1.
Figure 3:
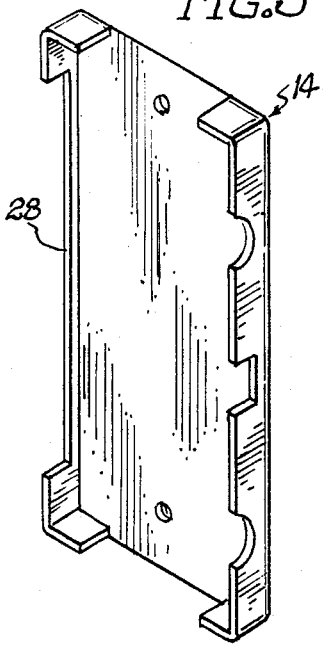
FIG. 3 illustrates one of the body covers isolated from the rest of the structure.

The release bar is loose and would rattle around if it were not for the outward bias that is applied through the camed cord plunger 32. The body of this plunger is on the left side 34 of the control as it would be seen with the release bar toward the viewer in FIG. 2, and the plunger 32 could best be seen in FIG. 5. The body slides along a corridor created by baffles of the core 12 of the left side of the central divider 16, and has a unitary leaf spring 36 which passes through a slot in a molded retainer nib 38 so that as the release bar is compressed, the camed cord plunger compresses the leaf spring 36 so that is biases the release bar outward and holds it in place.

The release bar also has a short paddle 40 that extends through the central partition 16 to the right side 42 of the partition, with this paddle sliding in a small slot 44 so that it can suitably depress the operative end of the cam element 46. The cam 46 has a unitary leaf spring 48, and is pivoted around a peg 50 which extends to the right of the partition to mount the cam element. By a glance at FIG. 4, it can be seen that as the cam cord plunger moves to the right, it depresses the cam element as shown in phantom, bending the leaf spring 48 and moving the cam out of the channel 24.

The cam preferably has a rough edge and forms a jaw with a roughened edge 51 of the channel 24 to engage and grip the respective cord 20 when the release bar is not compressed. Compressing the release bar moves the paddle 40, which moves the cam element and frees the channel 24 so the cord can easily pass back and forth inside. Because in its neutral position, the cord is engaged in the channel 24, the cam also serves to hold the control on the cord so it does not fall to the floor when it is not in use. If it is pulled down without depressing the release bar or any of the buttons, the suitable cord is pulled with it and closes the louvers. Obviously, the cords could be reversed so a downward pull would open the louvers if the user so desired.

In the desired mounting, the control has the three buttons shown in FIG. 1 facing the room so it is most easy to grab the control with the fingers on the release bar and the thumb on either one of the appropriate buttons, or on no button if the control needs to be free of all the chains and cords to move upwardly. Because some louver blinds have chains on the opposite side of the cords from other louver blind configurations, it is desirable to have the entire unit reversible so that it can be inverted from the configuration shown in FIG. 1, but still have the buttons facing into the room. The entire control is designed so that it can be used at either end of the blind or turned upside-down with no difference in function except the chains and cords would be on opposite respective sides, and the top control button would now control the channel that the lower button controlled earlier. The only exception to this is the cam element 46, which if maintained in the configuration of FIG. 4 would then push the cord in channel 24 up rather than down. Since this would not prevent the control from slipping downward, the cam is made reversible. It is removed from the peg 50 and reinserted on the peg in the opposite configuration as shown in phantom in FIG. 4 so that its preferably roughened face engages the second roughed spot 52 of the channel 24 rather than at 51, so that the direction of dogging versus the direction of substantially unimpeded motion through the channel 24 is reversed. Stops 53 define backstops for the cam in either position.

Figure 5:
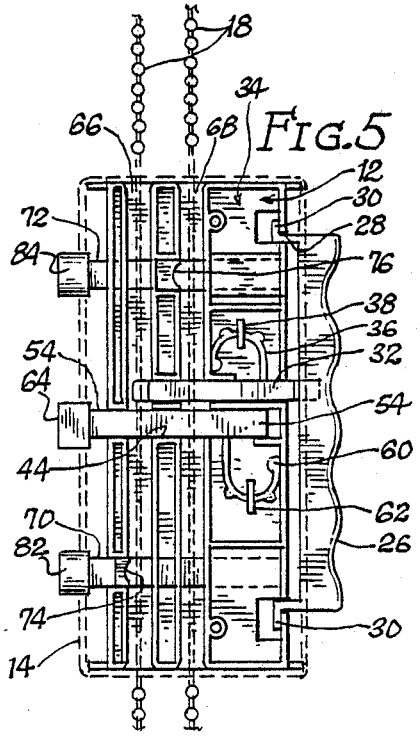
FIG. 5 is a view identical to FIG. 4 but on the opposite side of the control with the cover removed.

The other channel 24 is controlled by the camless cord plunger 54 which rides in a corridor defined on the left side of the central partition 16 as shown in FIG. 5, but has a jaw element 56 which extends through to the right side of the partition and selectibly compresses the cord 20 passing through the channel against the serrated opposite side 58 of the channel. Leaf spring 60 curls under a slot in the leaf spring detents 62, pressing against the inside of the covers 14 which acts as a biasing baffle as shown in FIG. 5. The square, protruding end of the camless cord plunger defines a button 64, which is square to distinguish is tactilely from the other two buttons on that side of the body, which are round.

Thus, it can be seen that when the control is gripped and pulled down with nothing being depressed, the cord in channel 24 is gripped and pulled down. If only the release bar is depressed, nothing is gripped and the control may be slid upwardly or downwardly in an idler movement on the chains and cords. If both the release bar and the button 64 are compressed, the other cord, which passes through channel 24, is engaged and pulled downwardly as the control is moved downwardly.

Thus, with the two controls thus far described, the release bar and the camless cord plungers, two blind movements are controlled: either cord being pulled down with the other one running free.

Turning now to the chain control, the channels 66 and 68 which pass the chains therethrough are defined on the left side of the central partition 16 as is best shown in FIG. 5. The chain plungers 72 which control the chains in channels 66 and 68, respectively, both pass substantially on the right side of the partition 16 and have jaws 74 and 76 which pass through respective openings onto the left side of the partition to engage the chains in their respective channels. The engaging faces of the respective jaws 74 and 76 are concave as can be seen in FIG. 5. If the ball chains are used, as shown in the illustrations, the concave jaws will grip one of the balls to provide a more positive engagement of the chain.

Figure 4:
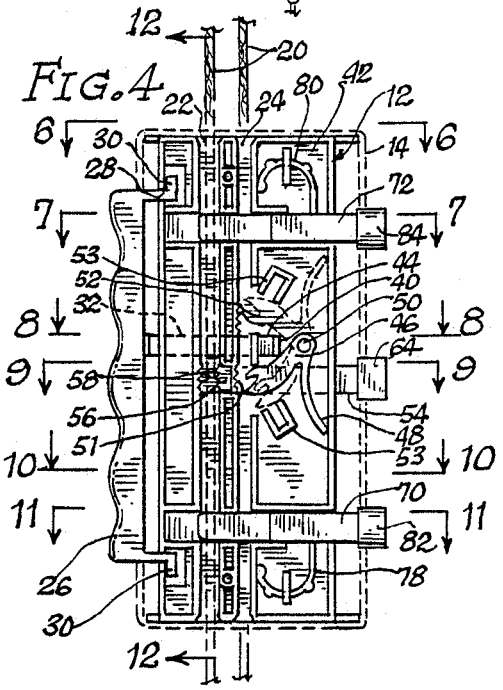
FIG. 4 illustrates the right side of the control as seen in FIG. 2 with the cover toward the viewer removed.

As shown in FIG. 4, each of the chain plungers has a leaf spring 78 and 80, respectively, which engages under the illustrated leaf spring detents 62 and presses against a biasing baffle strategically positioned on the right side of the central partition 16 as shown in FIG. 4. The plungers have round buttons 82 and 84 which protrude through apertures in the sides of the covers 14, and their round shape distinguished them from the central button 64, so that the user hopefully will develop a tactile memory association with the correct button for the correct operation. Because the buttons 82 and 84 control chains and are spaced on the opposite side of buttons 64, when the control is turned upside-down, the top and bottom buttons still control chains and a central button controls a cord, so the unit is operationally identical one way or the other.

Lastly, the two covers 14 encapsulate the entire structure except for the protruding buttons and release bar and are retained together by bolts 86 which pass through the suitable holes in the covers and the core 12 as is clearly shown in the drawings. As mentioned above, these holes in the bolts could be obviated by the defining of snap-on retainer detents in the covers so that the structure can be assembled and snapped together without the use of any fasteners whatsoever. This, together with the fact that although the central body portion 16 is somewhat intricate in construction, the rest of the parts are fairly simple and can be inexpensively injection molded so that the entire material cost for the unit is virtually nothing, and yet the end product is actually quite complex operationally in its ability to control all cord and chain movements to control louver blinds.

Additionally, although the invention has been described and claimed for louver blinds, it would clearly work on anything having a pair of depending two-strand loops, such as the chain and the cord of the louver blind, to control some kind of movement. The instant invention is, at the time of this patent application, either being produced for commercial distribution, or virtually at the production stage with the production prototype having been nearly perfected. Thus, it is expected that the invention will be a fairly common household item in a reasonably short time in marketing terms.

I claim:

1. A cord and chain control for a louver blind that has first and second cord strands to control the movement of the louvers as they traverse the louver open and closed, and first and second chain strands to control the individual rotation of the louvers into the respective open and closed positions, said control comprising:

(a) a body defining first and second longitudinal channels to pass said first and second cord strands therethrough, respectively, and third and fourth longitudinal channels to pass said first and second chain strands therethrough, respectively;

(b) a cam means operatively mounted in said body and biased into one of said first and second channels for engaging a first cord strand extended therethrough and means digitially operable externally of said body for pushing said cam means away from engagement with said first cord strand;

(c) a camless cord plunger means laterally slidably operable in said body and having a sliding path intersecting the other of said first and second channels for permitting said camless cord plunger means to selectably engage or disengage said second cord strand extended therethrough; and (d) first and second chain plunger means laterally slidably operable respectively in said third and fourth longitudinal channels for selectively engaging or disengaging said first and second chain strands extended therethrough.

2. Structure according to claim 1 wherein said cam means is directional and dogs said first cord strand extending through one of said first and second channels in which said cam means is operative when said first cord strand therein is pulled in one direction, but permits said first cord strand to move when said cord and chain control is pulled in an opposite direction.

3. Structure according to claim 2 wherein said cam means is reversibly mounted in said body such that the direction against which said first cord strand is dogged in said cord and chain control can be reversed.

4. Structure according to claim 3 wherein said cam means defines a jaw which cooperates with a serrated side disposed within one of said first and second channels in which it is operative, and said cam means is pivoted in said body to swing against said serrated side at less than a 90 degree angle, and can be reversed to swing against said serrated side from an opposite pivotal direction to reverse the sense in said cam means is operational.

5. Structure according to claim 4 wherein said means digitially operable externally of said body comprises a cam plunger extending outside of said body to be digitally depressible and having a paddle inside said body which pushes said cam means in a direction out of one of said first and second channels in which it is operative when said cam plunger is depressed.

6. Structure according to claim 5 wherein said cam means is biased into one of said first and second channels in which it is operative by a leaf spring unitary with said cam means and biased against an internal baffle structure disposed within said body, and said leaf spring also has the effect of biasing said cam plunger to its position of farthest protrusion outside of said body.

7. Structure according to claim 1 wherein said camless cord plunger means is biased away from engagement with said second cord strand within one of said first and second channels so said cam means engages said first cord strans and said camless cord plunger means is free of said second cord strand when neither said means digitally operable externally of said body nor said camless cord plunger means is depressed.

8. Structure according to claim 7 wherein said means digitally operable externally of saidbody includes a release bar externally operable of said body, and said camless cord plunger means extends through said body on an opposite side thereof from said release bar so that the release bar and camless cord plunger means can be easily depressed simultaneously by an individual's fingers and opposed thumb, respectively, of one hand.

9. Structure according to claim 8 wherein said first and second chain plunger means extend externally of said body on the side thereof opposite said release bar such that said first and second chain plunger means and camless chain means extend outside said body on the same side thereof, opposite said release bar, so that the release bar and any of said first and second chain plunger means and said camless chain plunger means can be simultaneously easily gripped with an individual's thumb and fingers respectively of one hand.

10. Structure according to claim 9 wherein an extended portion of said first and second chain plunger means and said camless cord plunger means define buttons, and said first and second chain plunger buttons are spaced evenly on opposite sides thereof of said camless cord plunger means so that said cord and chain control is reversible and can be used upside down.

11. Structure according to claim 10 wherein said body includes a pair of enclosing identical covers that meet on one side of said body along said buttons.

12. Structure according to claim 1 wherein said body has an interior baffle structure and said first and second chain plunger means are biased out of engagement with respective said first and second chain strands by means of unitary leaf springs bearing against said baffle structure.

13. Structure according to claim 12 wherein said first and second chain plunger means each has a chain-engaging face defining at least one concavity to capture at least one ball of a ball-like chain entrained through said third and fourth longitudinal channels respectively.

14. Structure according to claim 1 wherein said cord and chain control is substantially flat with a pair of planar sides, and said body has a central interior partition that is parallel to said sides and substantially bisects said cord and chain control, said first and second chain plunger means and said camless cord plunger means each slides in a corridor defined on one side of said partition and engages its respective cord or chain strand on the other side of said central interior partition.

15. Structure according to claim 14 wherein said body defines biasing baffles on said other side of said central partition, said first and second chain plunger means and said camless cord plunger means each defines a unitary biasing leaf spring on said other side of a said central interior partition engaging said biasing baffles.

* * * * *